US009107493B2

(12) United States Patent
Pan et al.

(10) Patent No.: US 9,107,493 B2
(45) Date of Patent: Aug. 18, 2015

(54) POP-UP ROTATABLE TRAY AND A TABLETOP COMPRISING THE SAME

(71) Applicant: Sunjoy Industries Group Ltd., Steubenville, OH (US)

(72) Inventors: Lianzhang Pan, Huzhou (CN); Qi Zhu, Jiaxing (CN)

(73) Assignee: Sunjoy Industries Group Ltd., Steubenville, OH (US)

( * ) Notice: Subject to any disclaimer, the term of this patent is extended or adjusted under 35 U.S.C. 154(b) by 45 days.

(21) Appl. No.: 14/033,451

(22) Filed: Sep. 21, 2013

(65) Prior Publication Data

US 2015/0083029 A1 Mar. 26, 2015

(51) Int. Cl.

| | |
|---|---|
| ***A47B 57/00*** | (2006.01) |
| ***A47B 13/08*** | (2006.01) |
| ***A47B 11/00*** | (2006.01) |
| ***A47B 9/00*** | (2006.01) |

(52) U.S. Cl.

CPC ..... *A47B 13/088* (2013.01); *A47B 9/00* (2013.01); *A47B 11/00* (2013.01); *A47B 2009/006* (2013.01)

(58) Field of Classification Search

CPC ..... F21V 33/00; F21V 33/0072; A47B 11/00; A47B 2200/0052; A47B 2200/005

USPC ..... 108/94, 95, 96, 23, 147.21

See application file for complete search history.

(56) References Cited

U.S. PATENT DOCUMENTS

| | | | | | |
|---|---|---|---|---|---|
| 48,888 | A | * | 7/1865 | Atwater | 108/96 |
| 316,979 | A | * | 5/1885 | Knoeller | 108/94 |
| 490,286 | A | * | 1/1893 | Hollowell | 108/95 |
| 505,602 | A | * | 9/1893 | Jackson | 108/95 |
| 556,566 | A | * | 3/1896 | Stevens | 108/66 |
| 732,227 | A | * | 6/1903 | Shafer et al. | 108/66 |
| 1,221,646 | A | * | 4/1917 | Zimmerman, Jr. | 108/96 |
| 2,079,225 | A | * | 5/1937 | Sabaneeff | 312/271 |
| 2,453,443 | A | * | 11/1948 | Logan | 108/94 |
| 2,680,660 | A | | 6/1954 | Stephens | |
| 2,730,416 | A | | 1/1956 | Williams | |
| 3,608,739 | A | | 9/1971 | Duboff | |
| 4,334,482 | A | | 6/1982 | Bolduc | |
| 4,747,352 | A | | 5/1988 | Guidry et al. | |

(Continued)

FOREIGN PATENT DOCUMENTS

| | | | |
|---|---|---|---|
| CN | 2129093 | Y | 4/1993 |
| CN | 1245668 | A | 3/2000 |

(Continued)

*Primary Examiner* — Jose V Chen

(74) *Attorney, Agent, or Firm* — The Law Office of Patrick F. O'Reilly III, LLC

(57) ABSTRACT

A pop-up rotatable tray assembly is disclosed herein. The pop-up rotatable tray assembly includes a base portion, a tray support structure rotatably coupled to the base portion, and a tray top member having a top surface. The tray top member is supported by the tray support structure, and the tray top member is configured to be adjustable between an elevated position and a retracted position. A tabletop assembly, which includes the pop-up rotatable tray assembly, is also disclosed herein. When the tray top member is disposed in the elevated position, the top surface of the tray top member is spaced apart from a top surface of a tabletop peripheral portion by a vertical distance. When the tray top member is disposed in the retracted position, the tray top member is substantially aligned with the top surface of the tabletop peripheral portion.

18 Claims, 12 Drawing Sheets

(56) References Cited

U.S. PATENT DOCUMENTS

| | | | | |
|---|---|---|---|---|
| 5,967,075 | A | 10/1999 | Johansen | |
| 6,463,946 | B1 * | 10/2002 | Wu | 135/16 |
| D471,035 | S | 3/2003 | Schwanke et al. | |
| 6,886,788 | B1 * | 5/2005 | Chung | 248/176.2 |
| 7,044,064 | B2 | 5/2006 | Li | |
| 7,124,694 | B2 | 10/2006 | Li | |
| 7,537,015 | B1 | 5/2009 | Molnar, IV et al. | |
| 7,984,679 | B1 * | 7/2011 | McFee | 108/106 |
| 8,291,840 | B2 * | 10/2012 | Baracchia | 108/147.19 |
| 2006/0075935 | A1 | 4/2006 | Li | |
| 2007/0062418 | A1 | 3/2007 | Li | |
| 2008/0134551 | A1 | 6/2008 | Conforti et al. | |
| 2009/0308286 | A1 * | 12/2009 | Bourbeau | 108/23 |
| 2011/0303124 | A1 * | 12/2011 | Tseng | 108/23 |
| 2012/0049033 | A1 | 3/2012 | Mosley | |
| 2013/0081609 | A1 | 4/2013 | Dhuper et al. | |

FOREIGN PATENT DOCUMENTS

| | | | |
|---|---|---|---|
| CN | 201067189 | Y | 6/2008 |
| CN | 201557272 | U | 8/2010 |
| EP | 051952 | B1 | 1/1986 |
| WO | 2011026535 | A2 | 3/2011 |
| WO | 2013104778 | A1 | 7/2013 |

* cited by examiner

Detail "A"

Detail "B"

Detail "C"

Detail "D"

Detail "E"

Detail "F"

Section A-A

POP-UP ROTATABLE TRAY AND A TABLETOP COMPRISING THE SAME

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a pop-up rotatable tray assembly. More particularly, the invention relates to a pop-up rotatable tray assembly that is integrated into a tabletop assembly.

2. Background and Description of Related Art

While dining, it is relatively common for a group of individuals to share one or more dishes during a meal (e.g., side dishes). However, when these individuals are all situated around the periphery of a table with a large interior portion, it is often difficult for the individuals to reach one or more of the dishes being shared. Consequently, if an individual sitting at the table needs a particular dish that is disposed a substantial distance away on the table, he or she must ask one or more of the other individuals sitting at the table to pass the dish to him or her. This request to pass the needed dish disrupts these other individuals while they are eating, and thus, may likely interfere with their ability to enjoy the meal.

Conventional devices are known that assist in moving food on a table or countertop. These conventional devices typically consist of a revolving turntable that is placed on the top surface of the table or countertop. While these conventional devices aid in moving food from one individual to another, they have numerous disadvantages. First, because these devices are external to the table or countertop itself, they must be removed and stowed away if it is desired to use the table or countertop without the device. Secondly, these conventional devices may be obstacles on the table or countertop, which interfere with an individual's ability to thoroughly enjoy his or her meal. Finally, the size and/or geometry of these conventional devices may not be congruent with the table or countertop on which they are being used (e.g., the device may be too small for a large table, the device may elevated too high above the surface of the table or countertop, etc.).

Therefore, what is needed is tabletop assembly with an integrated rotatable tray assembly that can be easily retracted into the tabletop when it is not being used. Also, a pop-up rotatable tray assembly is needed that is capable of being recessed into the surface of the tabletop so that it does not obstruct the use of the tabletop surface. In addition, a tabletop assembly is needed that includes an integrated rotatable tray assembly which is geometrically configured to function effectively with the overall shape and size of the tabletop.

BRIEF SUMMARY OF EMBODIMENTS OF THE INVENTION

Accordingly, the present invention is directed to a pop-up rotatable tray and a tabletop comprising the same that substantially obviates one or more problems resulting from the limitations and deficiencies of the related art.

In accordance with one or more embodiments of the present invention, there is provided a tabletop assembly including a tabletop peripheral portion, the tabletop peripheral portion having a central aperture disposed therethrough; and a pop-up rotatable tray assembly disposed within the central aperture of the tabletop peripheral portion. The pop-up rotatable tray assembly includes: a base portion; a tray support structure, the tray support structure rotatably coupled to the base portion; and a tray top member, the tray top member supported by the tray support structure, the tray top member configured to be adjustable between an elevated position and a retracted position. In these one or more embodiments, when the tray top member is disposed in the elevated position, the tray top member is spaced apart from the base portion by a first distance, and when the tray top member is disposed in the retracted position, the tray top member is spaced apart from the base portion by a second distance, the first distance being greater than the second distance.

In a further embodiment of the present invention, the base portion of the pop-up rotatable tray assembly comprises a central support post member disposed in an approximate center thereof, the central support post member including at least one helical slot formed therein.

In yet a further embodiment, the base portion of the pop-up rotatable tray assembly further comprises a plurality of spoke members extending radially outward from the central support post member.

In still a further embodiment, the pop-up rotatable tray assembly further comprises at least one engagement pin member that is configured to slidingly engage with the at least one helical slot in the central support post member of the base portion.

In yet a further embodiment, the tray support structure of the pop-up rotatable tray assembly comprises a plurality of peripheral support post assemblies spaced apart around the central support post member.

In still a further embodiment, each of the plurality of peripheral support post assemblies comprises an inner tubular member, an outer tubular member, and a spring member disposed around the inner tubular member and the outer tubular member, the spring member configured to bias the tray top member towards the elevated position.

In yet a further embodiment, the pop-up rotatable tray assembly further comprises a lighting assembly, the lighting assembly including a plurality of light emitting devices operatively coupled to a power source assembly by one or more electrical wires, the plurality of light emitting devices configured to illuminate one of: (i) at least a portion of the tray top member, and (ii) at least a portion of an outer peripheral rim of the pop-up rotatable tray assembly.

In still a further embodiment, the plurality of light emitting devices are configured to be automatically activated when the tray top member is disposed in the elevated position, and the plurality of light emitting devices are configured to be automatically deactivated when the tray top member is disposed in the retracted position.

In accordance with one or more other embodiments of the present invention, there is provided a pop-up rotatable tray assembly that includes: a base portion; a tray support structure, the tray support structure rotatably coupled to the base portion; and a tray top member having a top surface, the tray top member supported by the tray support structure, the tray top member configured to be adjustable between an elevated position and a retracted position, the tray top member being movable between the elevated position and the retracted position when a user applies at least one of a downward force and a torque to the top surface thereof. In these one or more embodiments, when the tray top member is disposed in the elevated position, the tray top member is spaced apart from the base portion by a first distance, and wherein, when the tray top member is disposed in the retracted position, the tray top member is spaced apart from the base portion by a second distance, the first distance being greater than the second distance.

In a further embodiment of the present invention, the tray top member is configured to be moved from the retracted position to the elevated position when the user applies both a downward force and a torque in a first rotational direction to the top surface of the tray top member.

In yet a further embodiment, the tray top member is configured to be moved from the elevated position to the retracted position when the user applies both a downward force and a torque in a second rotational direction to the top surface of the tray top member, the second rotational direction being opposite to the first rotational direction.

In still a further embodiment, the base portion comprises a central support post member disposed in an approximate center thereof, the central support post member including at least one helical slot disposed therethrough, the at least one helical slot having a first closed end and a second open end, the first closed end of the at least one helical slot including a notch formed therein.

In yet a further embodiment, the pop-up rotatable tray assembly further comprises at least one engagement pin member that is configured to slidingly engage with the at least one helical slot in the central support post member of the base portion.

In still a further embodiment, when the tray top member is disposed in the retracted position, the at least one engagement pin member is disposed in the notch at the first closed end of the at least one helical slot such that the tray top member is locked into a stationary position relative to the base portion; and when the tray top member is disposed in the elevated position, the at least one engagement pin member is disposed above the second open end of the at least one helical slot and is unconstrained by the at least one helical slot such that the tray top member is capable of being freely rotated in both a clockwise direction and a counter-clockwise direction by the user.

In accordance with yet one or more other embodiments of the present invention, there is provided a tabletop assembly including a tabletop peripheral portion, the tabletop peripheral portion having a central aperture disposed therethrough, the tabletop peripheral portion further including a top surface; and a pop-up rotatable tray assembly disposed within the central aperture of the tabletop peripheral portion. The pop-up rotatable tray assembly includes: a base portion; a tray support structure, the tray support structure rotatably coupled to the base portion; and a tray top member, the tray top member supported by the tray support structure, the tray top member configured to be adjustable between an elevated position and a retracted position. In these one or more embodiments, when the tray top member is disposed in the elevated position, the tray top member is spaced apart from the top surface of the tabletop peripheral portion by a vertical distance, and when the tray top member is disposed in the retracted position, a top surface of the tray top member is substantially aligned with the top surface of the tabletop peripheral portion.

In a further embodiment of the present invention, the base portion of the pop-up rotatable tray assembly is fixedly attached to an underside of the tabletop peripheral portion.

In yet a further embodiment, the tray top member of the pop-up rotatable tray assembly comprises an aperture disposed therein for receiving a pole member.

In still a further embodiment, the tray top member of the pop-up rotatable tray assembly is spaced apart from the tabletop peripheral portion by a continuous gap disposed about an outer periphery thereof such that the tray top member is capable of freely rotating relative to the tabletop peripheral portion.

In yet a further embodiment, the tray top member of the pop-up rotatable tray assembly comprises an annular member disposed about an outer periphery thereof, a first portion of the annular member configured to be disposed below the top surface of the tabletop peripheral portion when the tray top member is disposed in the elevated position, and a second portion of the annular member configured to be disposed above the top surface of the tabletop peripheral portion when the tray top member is disposed in the elevated position.

In still a further embodiment, the pop-up rotatable tray assembly is structurally supported only by the tabletop peripheral portion.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 12:
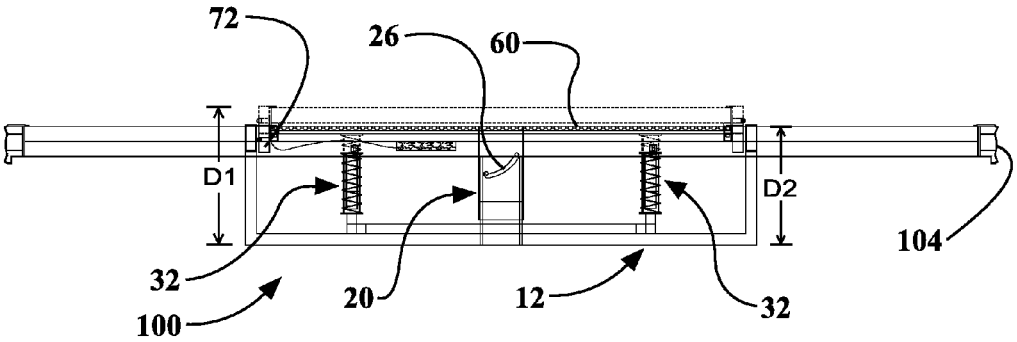
FIG. 12 is a sectional view of the tabletop assembly with the integrated pop-up rotatable tray assembly, according to an embodiment of the invention, wherein the section is generally cut along the cutting-plane line A-A in FIG. 11.
Figure 23:
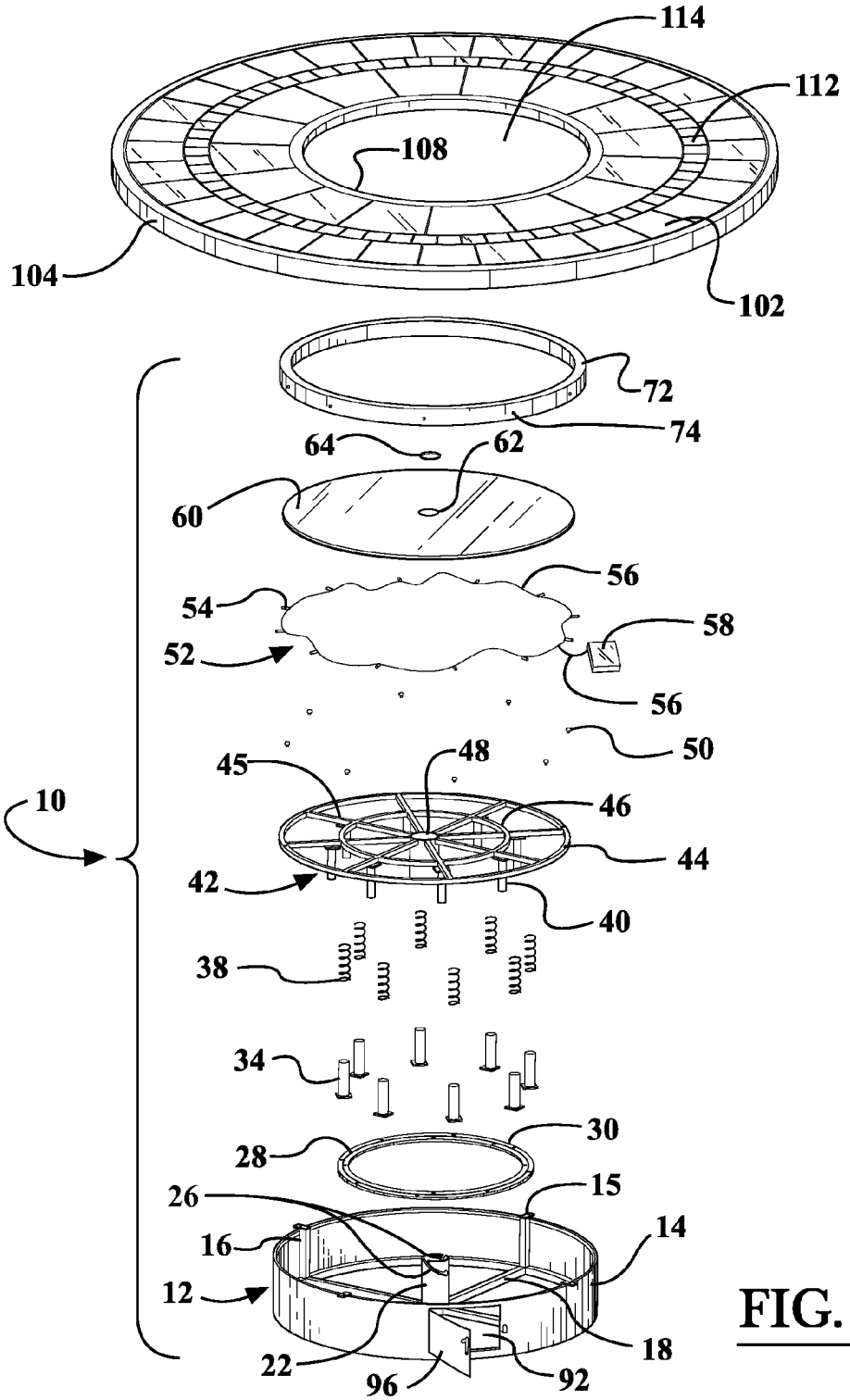
FIG. 23 is an exploded perspective view of the tabletop assembly with the integrated pop-up rotatable tray assembly, according to an embodiment of the invention.

An embodiment of the tabletop assembly with the integrated pop-up rotatable tray assembly is seen generally at 100 in FIGS. 1-3, 7, 11, 12, and 23. Initially, referring to FIG. 1, it can be seen that the tabletop assembly 100 supported by table legs 118 generally comprises a tabletop peripheral portion 102, the tabletop peripheral portion 102 having a central aperture 114 disposed therethrough (see e.g., FIG. 23); and a pop-up rotatable tray assembly 10 (i.e., a pop-up lazy susan 10) disposed within the central aperture 114 of the tabletop peripheral portion 102. As shown in FIGS. 12 and 23, the pop-up rotatable tray assembly 10 generally includes: (i) a base portion 12 disposed at the bottom of the assembly 10; (ii) a tray support structure (e.g., peripheral support post assemblies 32 and rotatable tray support frame 42), the tray support structure 32, 42 rotatably coupled to the base portion 12; and (iii) a tray top member (including tray disk portion 60 and annular member 72) supported by the tray support structure 32, 42). The tray top member 60, 72 is adjustable between an elevated position (e.g., refer to FIGS. 1 and 7) and a retracted position (see e.g., FIGS. 2 and 3). As shown in the section view of FIG. 12, when the tray top member 60, 72 is disposed in the elevated position (i.e., illustrated using dashed lines), the tray top member 60, 72 is spaced apart from the base portion 12 (i.e., the bottom surface of the base portion 12) by a first vertical distance D1. Conversely, when the tray top member 60, 72 is disposed in the retracted position (i.e., illustrated using solid lines), the tray top member 60, 72 is spaced apart from the base portion 12 (i.e., the bottom surface of the base portion 12) by a second vertical distance D2. In FIG. 12, it can be seen that the first vertical distance D1 is greater than the second vertical distance D2. In other words, with reference to FIGS. 1, 2, 6, and 10, when the tray top member 60, 72 is disposed in the elevated position (i.e., the FIG. 1 position), the top surface 11 of the tray top member 60, 72 is approximately spaced apart from the top surface 116 of the tabletop peripheral portion 102 by a vertical distance D3 (which equals D1 minus D2). Conversely, when the tray top member 60, 72 is disposed in the retracted position (i.e., the FIG. 2 position), a top surface 11 of the tray top member 60, 72 is substantially aligned with the top surface 116 of the tabletop peripheral portion 102 (i.e., the top surface 11 of the tray top member 60, 72 is substantially flush with the top surface 116 of the tabletop peripheral portion 102).

With particular reference to the sectional view of FIG. 10, it can be seen that a first portion P1 of the annular member 72 of the pop-up rotatable tray assembly 10, which circumscribes an outer periphery of the tray disk portion 60, is disposed below the top surface 116 of the tabletop peripheral portion 102 when the tray top member 60, 72 of pop-up rotatable tray assembly 10 is in its elevated position. As additionally shown in FIG. 10, a second portion P2 of the annular member 72 is disposed above the top surface 116 of the tabletop peripheral portion 102 when the tray top member 60, 72 of pop-up rotatable tray assembly 10 is its elevated position. In the sectional views of FIGS. 6 and 10, it can be seen that the annular member 72 includes an upper flange portion 76 that overlaps the top surface 11 of the tray disk portion 60 in order to help retain the tray disk portion 60 in the annular member 72.

In one or more embodiments of the invention, the pop-up rotatable tray assembly 10 is structurally supported only by the tabletop peripheral portion 102 (e.g., refer to the sectional view of FIG. 12). As such, there is no need to provide an independent floor stand for the pop-up rotatable tray assembly 10, which could deleteriously interfere with leg room under the table. In particular, the base portion 12 of the pop-up rotatable tray assembly 10 is fixedly attached to an underside of the tabletop peripheral portion 102. In the illustrated embodiment, with reference to the exploded view of FIG. 23, it can be seen that the outer peripheral wall 14 of the base portion 12 is provided with a plurality of outwardly extending tabs 15 spaced apart about a periphery thereof. Each outwardly extending tab 15 contains an aperture disposed therethrough for receiving a fastener (e.g., a screw) that is used to secure the pop-up rotatable tray assembly 10 to the underside of the tabletop peripheral portion 102.

As best illustrated in FIGS. 2, 3, 6, and 10, the tray top member 60, 72 of the pop-up rotatable tray assembly 10 is spaced apart from the tabletop peripheral portion 102 by a continuous gap 84 disposed about an outer periphery thereof such that the tray top member 60, 72 is capable of freely rotating relative to the tabletop peripheral portion 102 (e.g., in its elevated position). More particularly, referring to the detailed sectional views of FIGS. 6 and 10, it can be seen that the outer peripheral surface of the annular member 72 of the pop-up rotatable tray assembly 10 is separated from the inner annular edge 108 of the inner annular flange member 110 of the tabletop peripheral portion 102 by the continuous gap 84.

Referring to FIGS. 1-3, 6, 7, 10, and 11, the features of the tabletop peripheral portion 102 will be described in detail. In the overall perspective views of FIGS. 1-3, 7, and 11, it can be seen that the tabletop peripheral portion 102 generally comprises an annular plate member 106 circumscribed by an outer circular edge member 104. In the illustrated embodiment, it can be seen that the annular plate member 106 is provided with a decorative pattern 112 formed therein or thereon so as to enhance the aesthetic characteristics of the tabletop assembly 100. However, it is to be understood that, in other embodiments of the invention, the annular plate member 106 of the tabletop peripheral portion 102 is a plain sheet of material (e.g., a plain sheet of glass) without any decorative pattern 112 formed therein or thereon. As briefly discussed above, the central aperture 114 of the tabletop peripheral portion 102 is bounded by an inner flange member 110 of the tabletop peripheral portion 102 (see FIGS. 6 and 10), which includes the inner annular edge 108.

Figure 15:
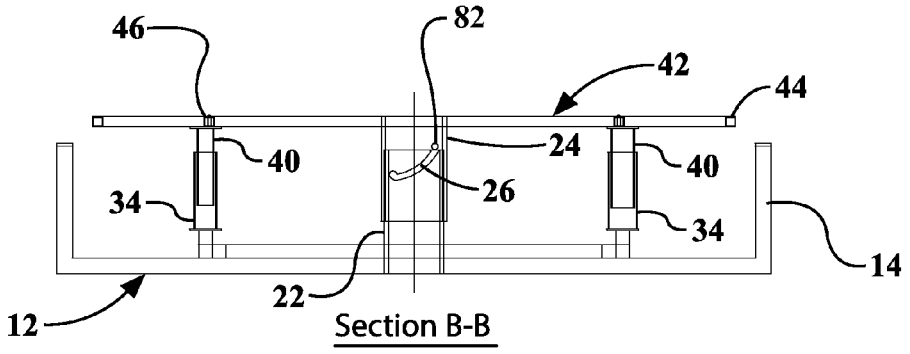
FIG. 15 is a sectional view of the tray support structure of the pop-up rotatable tray assembly, according to an embodiment of the invention, wherein the section is generally cut along the cutting-plane line B-B in FIG. 16.
Figure 16:
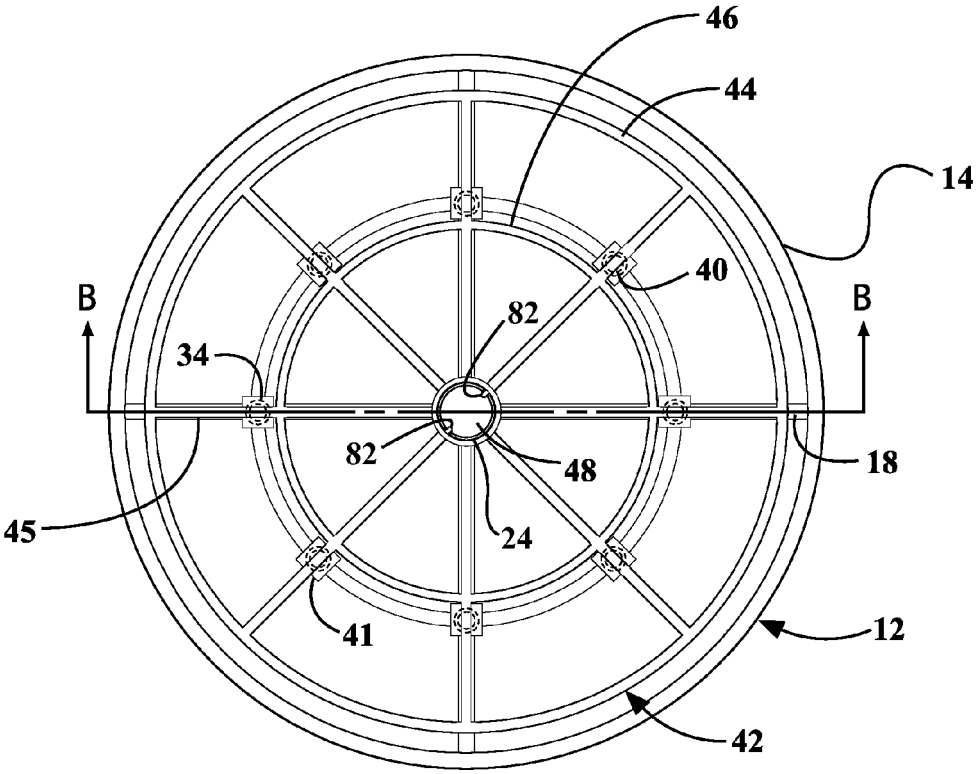
FIG. 16 is a top view of the tray support structure of the pop-up rotatable tray assembly, according to an embodiment of the invention.

Now, with reference to FIGS. 4, 5, 8, 9, and 12-23, the pop-up rotatable tray assembly 10 of the tabletop assembly 100 will be described in detail. Initially, the structure of the base portion 12 of the pop-up rotatable tray assembly 10 will be explained. In the exploded view of FIG. 23, it can be seen that the base portion 12 of the pop-up rotatable tray assembly 10 comprises a central support post member 22 disposed in an approximate center thereof, and extending in a generally perpendicular manner from the bottom of the base portion 12. The central support post member 22, which is in the form of an inner tubular member, includes at least one helical or arcuate slot 26 formed therein (see FIGS. 5, 9, 12, and 15) for slidingly receiving an engagement pin member 82. In a preferred embodiment, the central support post member 22 includes two helical or arcuate slots 26 formed therein (see FIG. 23), each of which slidingly receives a respective engagement pin member 82. Preferably, each of the two helical or arcuate slots 26 are disposed on generally opposite sides of the central support post member 22. The engagement pin members 82 are disposed opposite one another on the internal curved surface of the outer tubular member 24 (see e.g., FIGS. 15 and 16). With reference again to FIG. 23, it can be seen that the base portion 12 further comprises a plurality of spoke members 18 extending radially outward from the central support post member 22. Turning to the perspective views of FIGS. 13 and 14, it can be seen that the spoke members 18 are circumferentially spaced apart about the circumference of the central support post member 22 (e.g., four (4) spoke members 18 are shown in the illustrated embodiment). At their outer ends, each spoke member 18 is affixed to a respective strengthening rib 16, which is disposed in a generally vertical orientation. In turn, each strengthening rib 16 is fixedly attached to the outer peripheral wall 14 of the base portion 12 (the circular peripheral wall 14 circumscribes the pop-up rotatable tray assembly 10 and generally encloses all of its internal components so as to give the pop-up rotatable tray assembly 10 a more finished appearance.

As depicted in the exploded view of FIG. 23, the outer peripheral wall 14 of the base portion 12 is provided with an aperture 92 disposed therein so that a user is able to gain access to the power source assembly 58 of the lighting assembly 52 (e.g., to change the batteries in the power source assembly 58, etc.). The details of the lighting assembly 52 of the pop-up rotatable tray assembly 10 will be described hereinafter. Also, as shown in FIG. 23, the aperture 92 in the wall 14 is preferably provided with a hinged access door 96 so that the opening 92 can be closed when the power source assembly 58 of the lighting assembly 52 is not being accessed.

Figure 5:
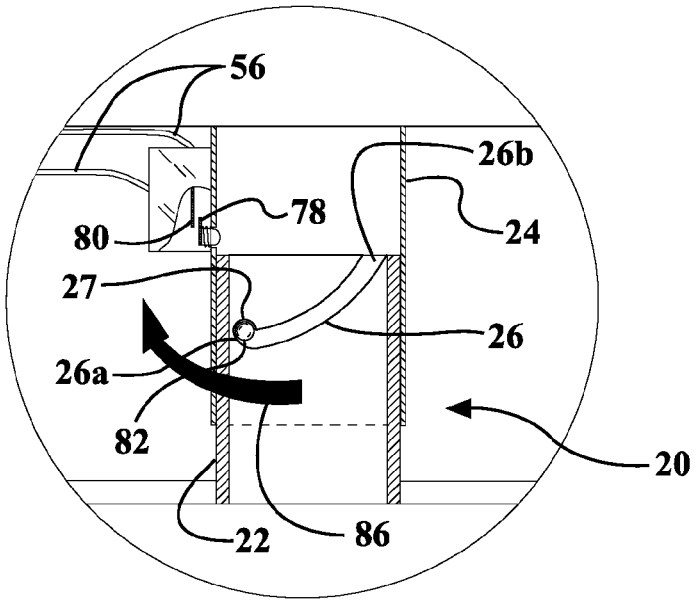
FIG. 5 is an enlarged, partial sectional view of the central support post assembly of the pop-up rotatable tray assembly (Detail "B"), according to an embodiment of the invention, wherein an engagement pin member of the central support post assembly is shown disposed in a notch thereof so that the pop-up rotatable tray assembly is locked into place in its retracted position.
Figure 13:
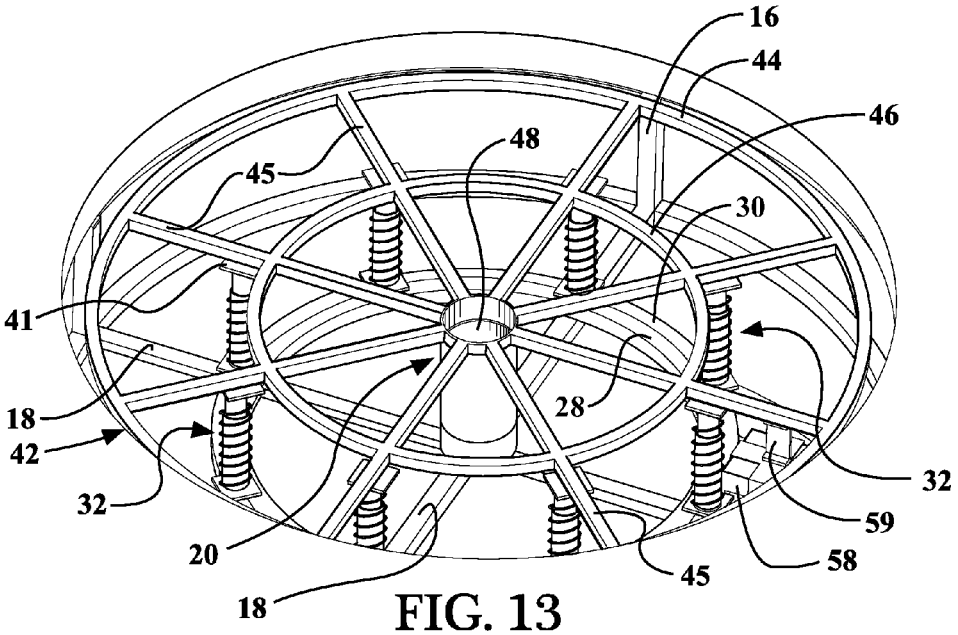
FIG. 13 is a perspective view of a tray support structure of the pop-up rotatable tray assembly, according to an embodiment of the invention, wherein the spring members of the peripheral support post assemblies are compressed.
Figure 14:
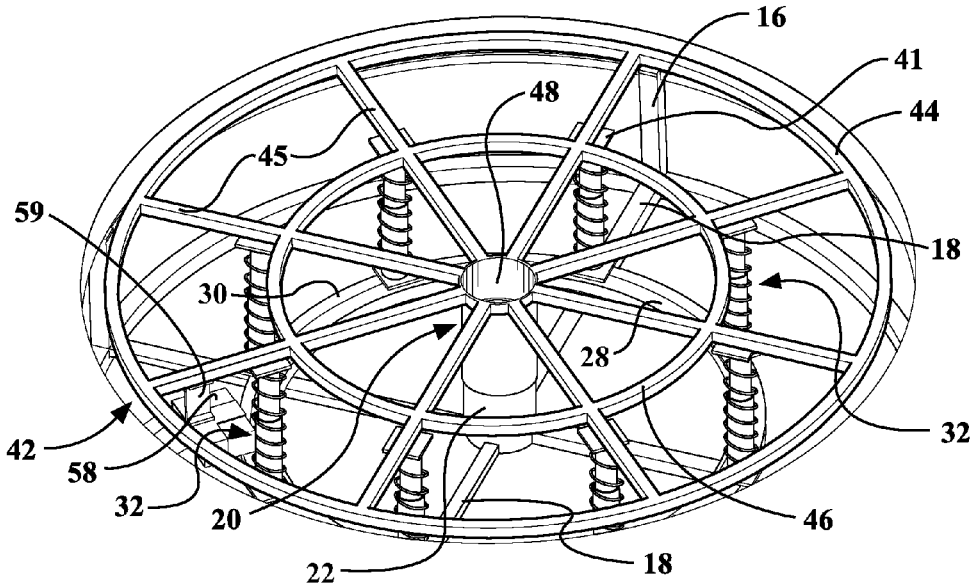
FIG. 14 is a perspective view of the tray support structure of the pop-up rotatable tray assembly, according to an embodiment of the invention, wherein the spring members of the peripheral support post assemblies are uncompressed.

As briefly described above, the tray top member 60, 72 is structurally supported by a tray support structure, which generally includes a central support post assembly 20 (refer to FIGS. 5, 9, and 22), peripheral support post assemblies 32 (see FIGS. 4, 8, and 12-15), and a rotatable tray support frame 42 (refer to FIGS. 13 and 14). First, referring primarily to FIGS. 5, 9, and 22, the structure and functional features of the central support post assembly 20 will be explained. As shown in these three figures, the central support post assembly 20 comprises an inner tubular member 22 (i.e., central support post member 22 of base portion 12) with helical/arcuate slots 26, an outer tubular member 24 that slidingly engages the inner tubular member 22, and engagement pin members 82 that slidingly engage with respective helical/arcuate slots 26 in the inner tubular member 22. With particular reference to FIG. 5, it can be seen that each helical/arcuate slot 26 in the inner tubular member 22 has a first closed end **26*a* and a second open end 26*b*. The first closed end 26*a* of the helical/arcuate slot 26 includes a notch 27 formed therein (i.e., the slot 26 has a notched end portion). When the tray top member 60, 72 is disposed in the retracted position (e.g., FIG. 2 position), each engagement pin member 82 is disposed in a respective notch 27 at the respective first closed end 26*a* of its respective helical/arcuate slot 26 such that the tray top member 60, 72 is locked into a stationary position relative to the base portion 12. On the other hand, when the tray top member 60, 72 is disposed in the elevated position (FIG. 1 position), each engagement pin member 82 is disposed above the second open end 26*b* of its respective helical/arcuate slot 26 (see upper position of pin member 82 in FIG. 22) and is unconstrained by the helical/arcuate slot 26 such that the tray top member 60, 72 is capable of being freely rotated in both a clockwise direction 86 and a counter-clockwise direction 90** by the user.

Secondly, with reference to FIGS. 4, 8, and 12-15, the peripheral support post assemblies 32 of the tray support structure will be described. In the perspective views of FIGS. 13 and 14, it can be seen that a plurality of peripheral support post assemblies 32 are circumferentially spaced apart around the central support post assembly 20. In the illustrated embodiment, a total of eight (8) peripheral support post assemblies 32 are approximately equal spaced apart about the central support post assembly 20 (i.e., the peripheral support post assemblies 32 are spaced apart from each other in approximately 45 degree increments). However, it is to be understood that, in other embodiments of the invention, more than eight (8) peripheral support post assemblies 32 or less than eight (8) peripheral support post assemblies 32 may be provided as part of the tray support structure so long as the tray top member 60, 72 is adequately supported thereby. With combined reference to FIGS. 4, 8, and 15, it can be seen that each of the plurality of peripheral support post assemblies 32 comprises an outer tubular member 34 with a square base 36, an inner tubular member 40 with square base 41, and a spring member 38 disposed around the inner tubular member 40 and the outer tubular member 34. The inner tubular member 40 is slidingly received within the outer tubular member 34 (see FIG. 15). As shown in FIGS. 4, 8, and 13-16, the lower square base 36 of each outer tubular member 34 is affixedly secured to the outer, movable base ring 30, while the upper square base 41 of each inner tubular member 40 is affixedly secured to a respective spoke 45 of the rotatable tray support frame 42 (e.g., by welding it thereto). The spring member 38 of each peripheral support post assembly 32 is configured to bias the tray top member 60, 72 towards its elevated position (i.e., FIG. 1 position) so that pin members 82 remain elevated above the second open ends 26*b* of engagement slots 26 when the tray top member 60, 72 is in its raised position.

Thirdly, with reference to FIGS. 13-16, the rotatable tray support frame 42 of the tray support structure will be explained. As illustrated in these figures, the rotatable tray support frame 42 generally comprises a plurality of spoke members 45 circumferentially spaced apart around the central support post assembly 20, an outer annular member 44 affixed to the outer ends of each of the spoke members 45, and an inner annular member 46 affixed to a respective middle portion of each of the spoke members 45. The inner annular member 46 is disposed approximately halfway between the outer annular member 44 and the central support post assembly 20. In FIGS. 13 and 14, it can be seen that the members 44, 45, 46 collectively form a rigid support frame 42 for supporting the weight of the tray top member 60, 72. Also, as illustrated in these two figures, the rotatable tray support frame 42 further comprises a central aperture 48 disposed therethrough that is connected to the hollow interior portion of inner tubular member 22 (i.e., the internal passageway of inner tubular member 22). In the illustrated embodiment, a total of eight (8) spoke members 45 are approximately equal spaced apart about the central support post assembly 20 (i.e., the spoke members 45 are spaced apart from each other in approximately 45 degree increments). However, it is to be understood that, in other embodiments of the invention, more than eight (8) spoke members 45 or less than eight (8) spoke members 45 may be provided as part of the tray support structure so long as the tray top member 60, 72 is adequately supported thereby.

In one embodiment of the invention, the tray support structure, which includes the rotatable tray support frame 42, is formed from steel. In other embodiments of the invention, the tray support structure is formed from another metal or a metal alloy. Those of ordinary skill in the art will appreciate that the tray support structure can be formed from various other suitable materials, provided that the selected material is suitably durable and is rigid.

Figure 6:
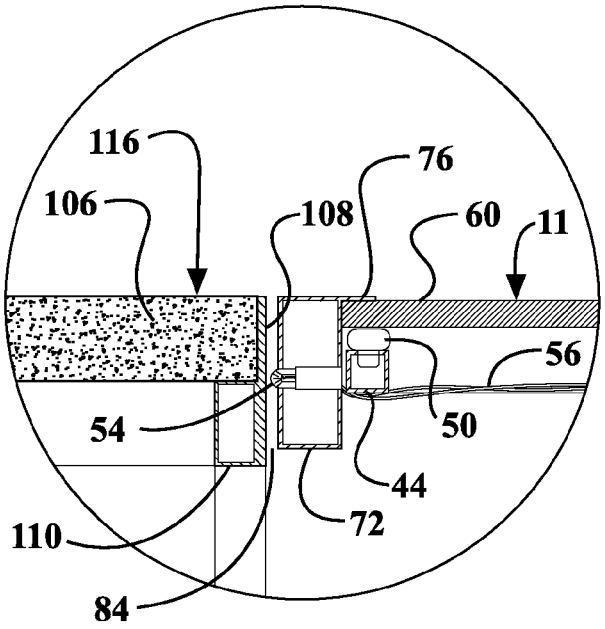
FIG. 6 is an enlarged, partial sectional view of the outer edge portion of the pop-up rotatable tray assembly and the inner edge portion of the tabletop assembly (Detail "C"), according to an embodiment of the invention, wherein the pop-up rotatable tray assembly is disposed in a retracted position.
Figure 7:
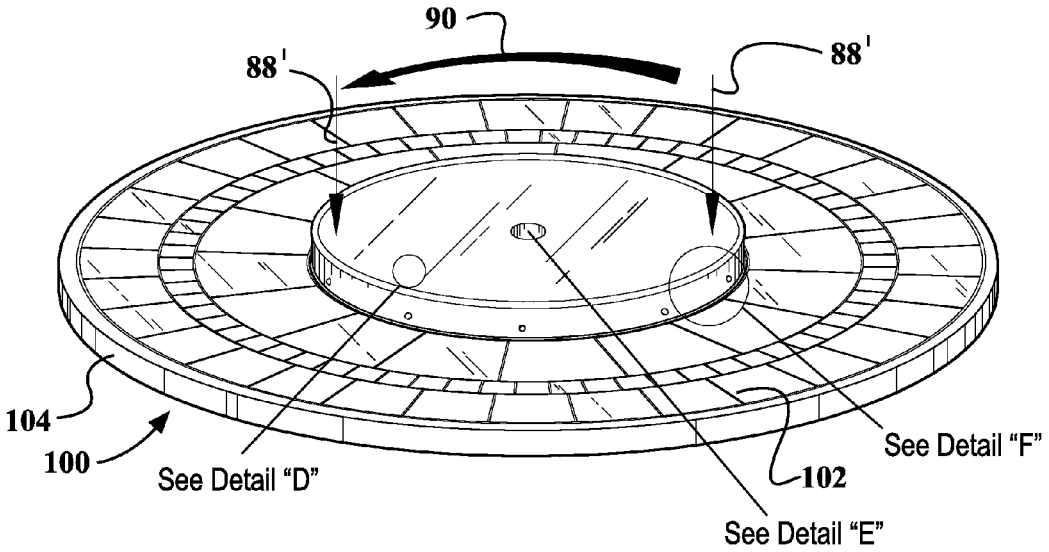
FIG. 7 is still another perspective view of the tabletop assembly with the integrated pop-up rotatable tray assembly, according to an embodiment of the invention, wherein the pop-up rotatable tray assembly is disposed in an elevated position.
Figure 8:
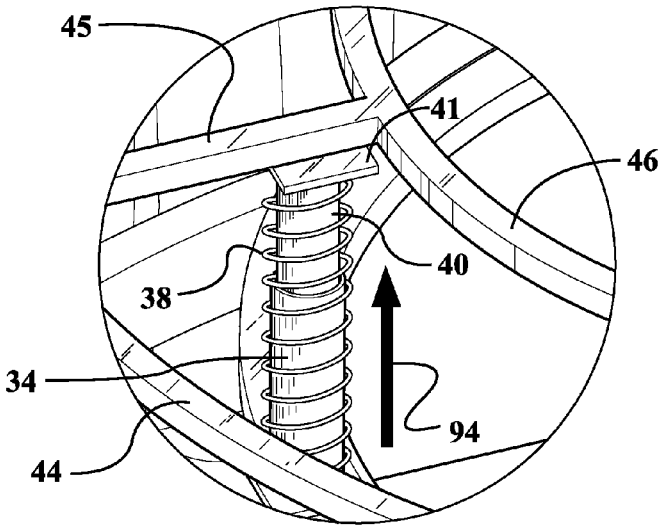
FIG. 8 is another enlarged, partial perspective view of one of the peripheral support post assemblies of the pop-up rotatable tray assembly (Detail "D"), according to an embodiment of the invention, wherein the spring member of the peripheral support post assembly is uncompressed.
Figure 10:
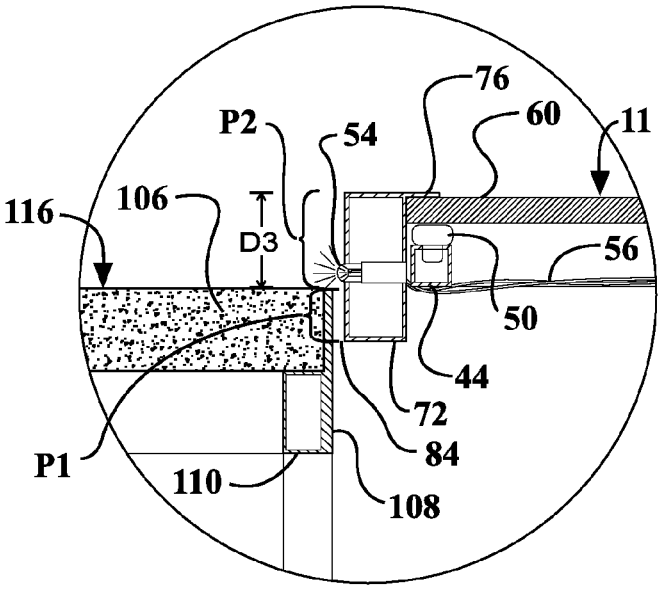
FIG. 10 is another enlarged, partial sectional view of the outer edge portion of the pop-up rotatable tray assembly and the inner edge portion of the tabletop assembly (Detail "F"), according to an embodiment of the invention, wherein the pop-up rotatable tray assembly is disposed in an elevated position.
Figure 11:
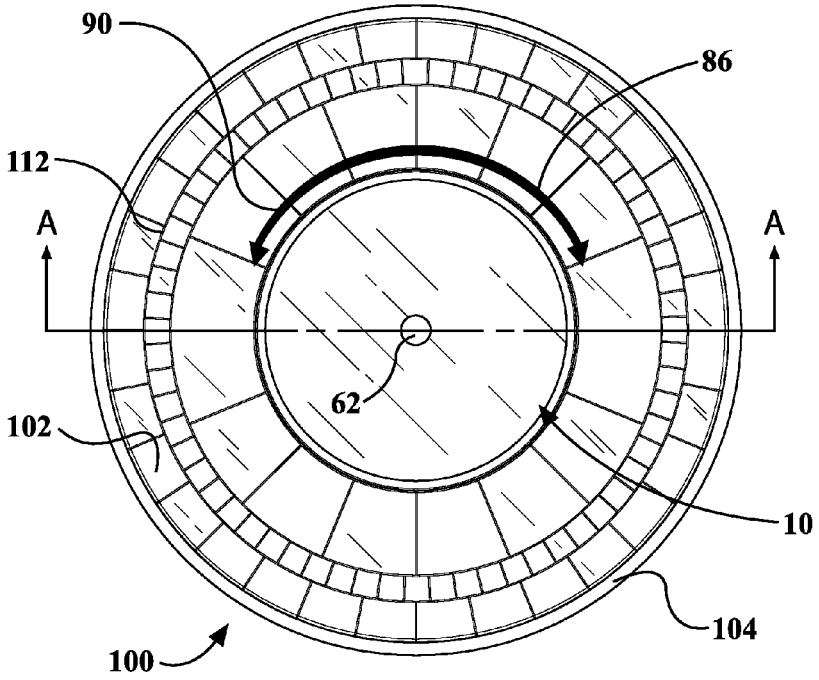
FIG. 11 is a top view of the tabletop assembly with the integrated pop-up rotatable tray assembly, according to an embodiment of the invention.

Turning to the detail sectional views of FIGS. 6 and 10, as well as the exploded view of FIG. 23, it can be seen that the tray disk portion 60 of the tray top member 60, 72 lies on a plurality of support pads 50 that are sandwiched between the bottom surface of the tray disk portion 60 and the top surface of the outer tubular member 44 of the rotatable tray support frame 42. In one or more embodiments, each of the support pads 50 is generally mushroom-shaped with a lower stem portion that is received within an aperture in the top surface of the outer tubular member 44 (e.g., see FIGS. 6 and 10). Preferably, each of the support pads 50 is formed from a compressible rubber or plastic material so that the top cap portion of each support pad 50 is slightly compressed when the weight of the tray disk portion 60 is placed thereon. Advantageously, utilizing a resilient, compressible rubber or plastic material for each the support pads 50, would help protect the bottom surface of the tray disk portion 60 from scratches, and other undesirable markings (e.g., the support pads 50 would protect a glass tray disk portion 60 from being scratched by the metallic outer tubular member 44 of the rotatable tray support frame).

Figure 17:
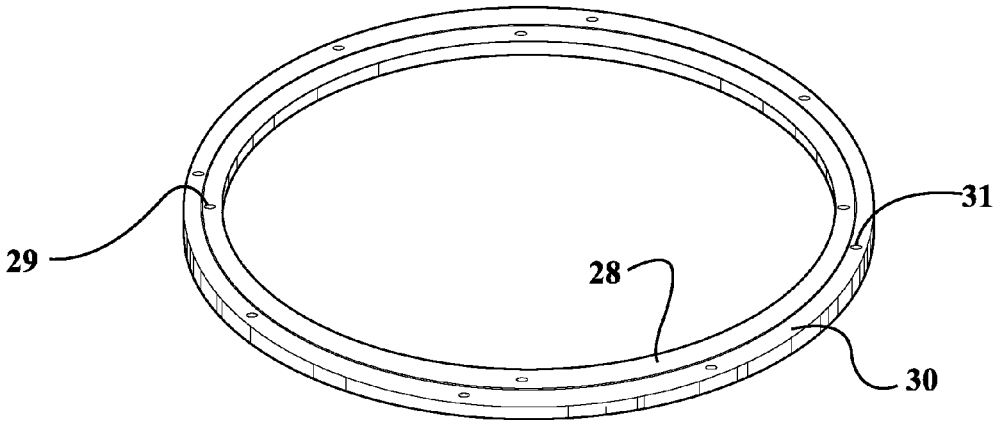
FIG. 17 is a perspective view of concentric base ring members of the pop-up rotatable tray assembly, according to an embodiment of the invention.

In the illustrated embodiment, the tray support structure is rotatably coupled to the base portion 12 of the pop-up rotatable tray assembly 10 by means of concentric base ring members 28, 30 (refer to FIGS. 17 and 23). Specifically, the inner base ring member 28 is fixedly attached to each of the four (4) spoke members 18 of the base portion 12 by means of a plurality of fasteners (e.g., screws) that are received within respective apertures 29 of the inner base ring member 28. The outer base ring member 30 circumscribes the inner base ring member 28, and rotates relative to the inner base ring member 28 on a plurality of ball members disposed between the ring members 28, 30 (i.e., together the ring members 28, 30 form a large ball bearing with a plurality of tiny balls being disposed in the gap between the outer surface of the inner base ring member 28 and the inner surface of the outer base ring member 30). In FIG. 17, it can be seen that the outer base ring member 30 is provided with a plurality of apertures 31 (e.g., eight (8) apertures) for receiving respective fasteners (e.g., screws) therein. That is, the fasteners passing through the apertures 31 affix the outer base ring member 30 to the square bases 36 of the outer tubular members 34 of the peripheral support post assemblies 32 (refer to FIGS. 4, 13, and 16). As such, the tray support structure of the pop-up rotatable tray assembly 10 rotates together with the outer base ring member 30 relative to the inner base ring member 28. In FIG. 17, it can be seen that inner and outer base ring members 28, 30 are generally concentric with one another.

Figure 18:
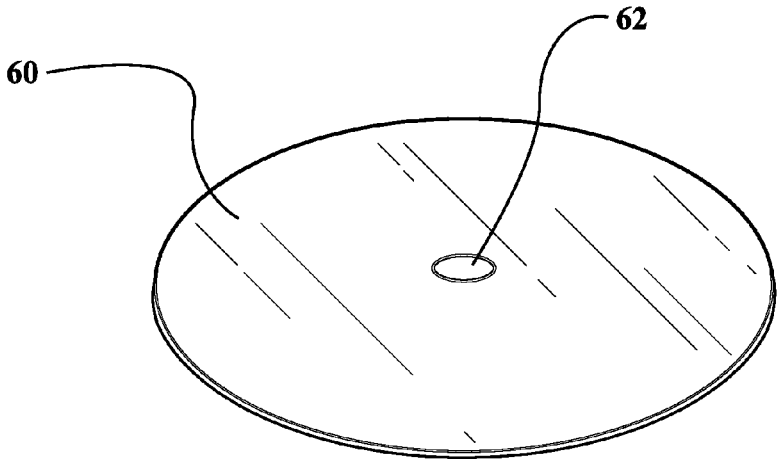
FIG. 18 is a perspective view of a tray top member of the pop-up rotatable tray assembly, according to an embodiment of the invention.
Figure 19:
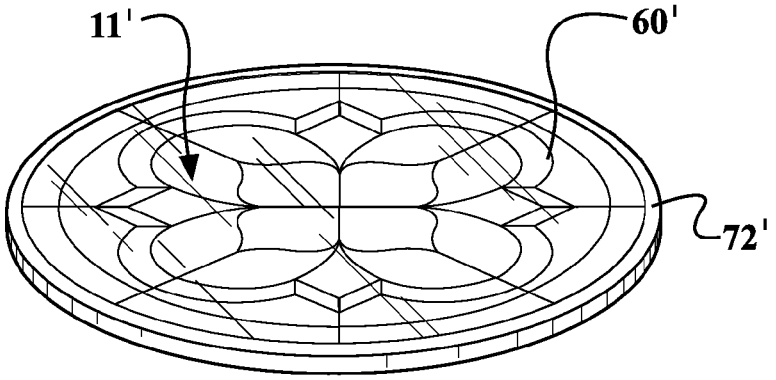
FIG. 19 is a perspective view of an alternative design for the tray top member and annular member of the pop-up rotatable tray assembly, according to an embodiment of the invention.

In one or more embodiments, the tray disk portion 60 of the tray top member 60, 72 is generally a circular disk with a central aperture 62 disposed in the approximate center thereof (refer to FIGS. 18 and 23). The central aperture 62 in the tray disk portion 60 of the tray top member 60, 72 is configured to receive a pole member passing therethrough (e.g., the central aperture 62 may accommodate an umbrella pole member passing therethrough if the tabletop assembly 100 is a patio table with an umbrella canopy). However, it is to be understood that, in other alternative embodiments of the invention, the tray disk portion 60 of the tray top member 60, 72 may also be provided without a central aperture 62 disposed therethrough (e.g., see FIG. 19) when a table having a solid top is desired. In FIG. 19, it can be seen that the top surface 11' of the tray disk portion 60' is solid without any holes disposed therethrough. Also, the annular member 72' of the tray top member 60', 72' in FIG. 19 is not provided with a plurality of apertures for receiving light emitting devices 54. In this embodiment of the tray top member 60', 72', the light emitting devices 54 can be mounted underneath a generally translucent tray disk portion 60', rather than being circumferentially disposed within the annular member (see FIG. 20).

In one embodiment of the invention, the tray disk portion 60 of the tray top member 60, 72 is formed from glass. In other embodiments of the invention, the tray disk portion 60 is formed from a generally rigid plastic or a composite material. Those of ordinary skill in the art will appreciate that the tray disk portion 60 can be formed from various other suitable materials, provided that the selected material is suitably durable and is rigid.

Figure 21:
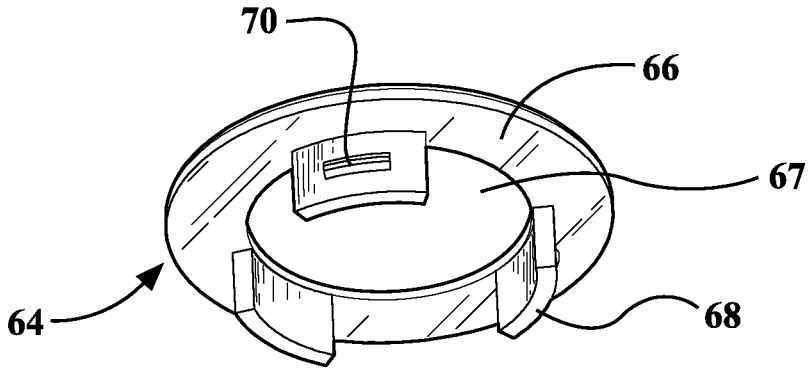
FIG. 21 is a bottom perspective view of a central aperture ring member of the pop-up rotatable tray assembly, according to an embodiment of the invention.

Initially, with reference to the exploded view of FIG. 23, it can be seen that the central aperture 62 in the tray disk portion 60 is preferably provided with a central aperture ring member 64 received therein. The detailed features of the central aperture ring member 64 are illustrated in FIG. 21. As shown in this figure, the central aperture ring member 64 generally comprises an upper collar portion 66 and a plurality of engagement tabs or prongs 68 extending generally downwardly from the bottom surface of the upper collar portion 66. The upper collar portion 66, which is disposed at the respective upper end of each engagement tab 68, is in the form of a peripheral flange. The bottom surface of the flange-like collar portion 66 of the central aperture ring member 64 is designed to rest on the top surface 11 of the tray disk portion 60. As depicted in FIG. 21, each of the engagement tabs 68 is provided with a side protruding member 70 disposed in the approximate middle region thereof. Preferably, each of the engagement tabs 68 are formed from a resilient material (e.g., a resilient plastic) so that the central aperture ring member 64 can be received within the central aperture 62 of the tray disk portion 60 in a friction-fit type engagement with the adjoining surfaces of the tray disk portion 60 (i.e., the outer surfaces of the engagement tabs or prongs 68 frictionally engage the internal peripheral surface of the aperture 62, while the side protruding members 70 on each tab or prong 68 snap underneath the bottom of the tray disk portion 60). Also, as shown in FIG. 21, the central aperture ring member 64 is provided with a central aperture 67 extending therethrough in order to accommodate a pole member (e.g., an umbrella pole).

Figure 20:
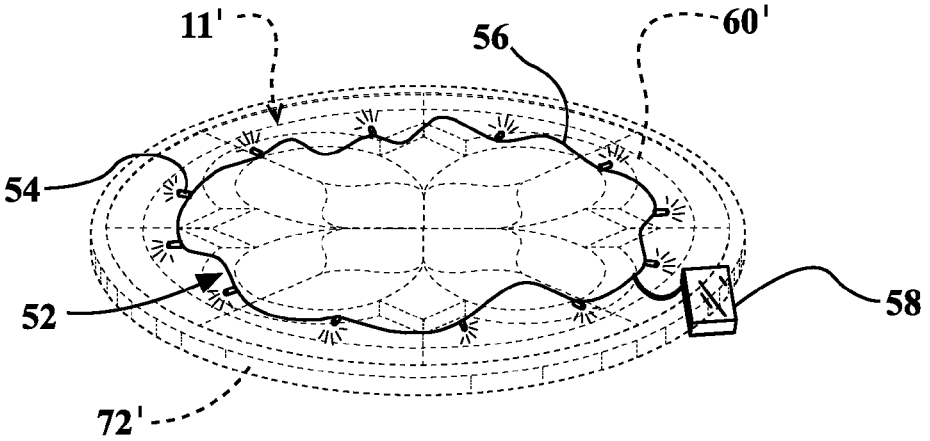
FIG. 20 is a perspective view depicting an alternative location for the lighting assembly of the pop-up rotatable tray assembly, according to an embodiment of the invention.

Next, with initial reference to FIGS. 1, 10, and 23, the lighting assembly 52 of the pop-up rotatable tray assembly 10 will be explained. As best shown in the exploded view of FIG. 23, the lighting assembly 52 includes a plurality of light emitting devices 54 operatively coupled to a power source assembly 58 by one or more electrical wires 56. In one embodiment of the invention, the plurality of light emitting devices 54 are configured to illuminate at least a portion of an outer peripheral rim of the pop-up rotatable tray assembly 10 (see e.g., FIGS. 1 and 10), while in another alternative embodiment, the plurality of light emitting devices 54 are configured to illuminate at least a portion of the tray top member 60, 72 (e.g., the underside of the tray disk portion 60—see FIG. 20). The light emitting devices 54 in FIG. 20 are disposed below the underside of the tray disk portion 60', and the tray disk portion 60' is formed from a material that is substantially translucent (e.g., glass or a generally translucent plastic) so as to allow the light emitted by the devices 54 to pass therethrough. In the embodiment wherein the plurality of light emitting devices 54 illuminate at least a portion of an outer peripheral rim of the pop-up rotatable tray assembly 10, the annular member 72 of the tray top member 60, 72 is provided with a plurality of circumferentially spaced apart apertures therearound for receiving respective light emitting devices 54. In a preferred embodiment, the power source assembly 58 comprises a battery pack for receiving a plurality of batteries (e.g., three (3) AA alkaline batteries) that supply power to the light emitting devices 54 of the lighting assembly 52. As shown in FIGS. 13 and 14, the power source assembly 58 may be supported from one of the spoke members 45 by a bracket assembly 59. The one or more electrical wires 56 electrically couple the power source assembly 58 to the light emitting devices 54. In one or more embodiments, each of the plurality of light emitting devices 54 is in the form of a light emitting diode (LED) light source. Although, in an alternative embodiment, each of the plurality of light emitting devices 54 could be in the form of an incandescent, filament-type light bulb.

Figure 1:
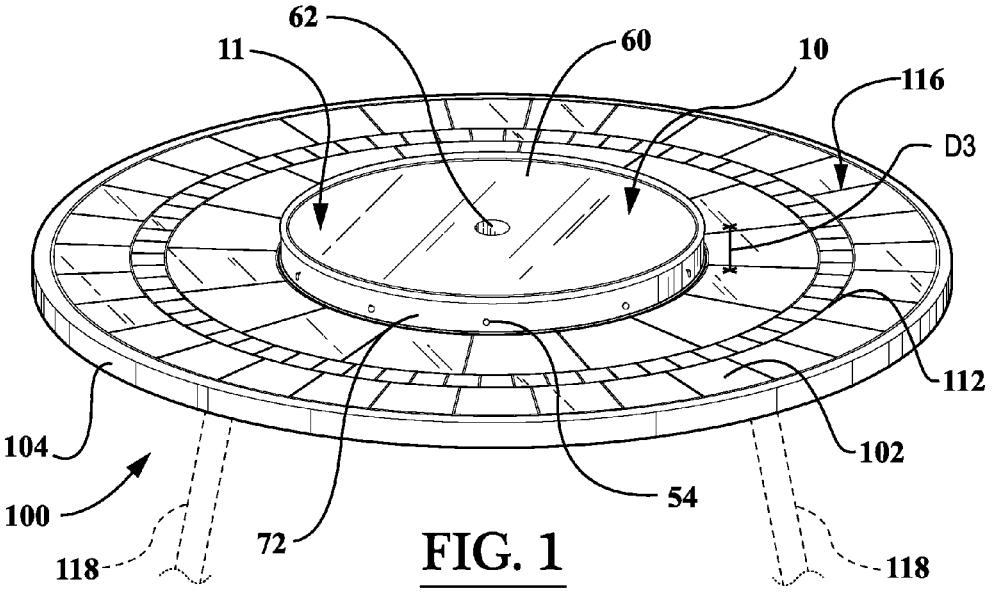
FIG. 1 is a perspective view of a tabletop assembly with an integrated pop-up rotatable tray assembly, according to an embodiment of the invention, wherein the pop-up rotatable tray assembly is disposed in an elevated position.
Figure 9:
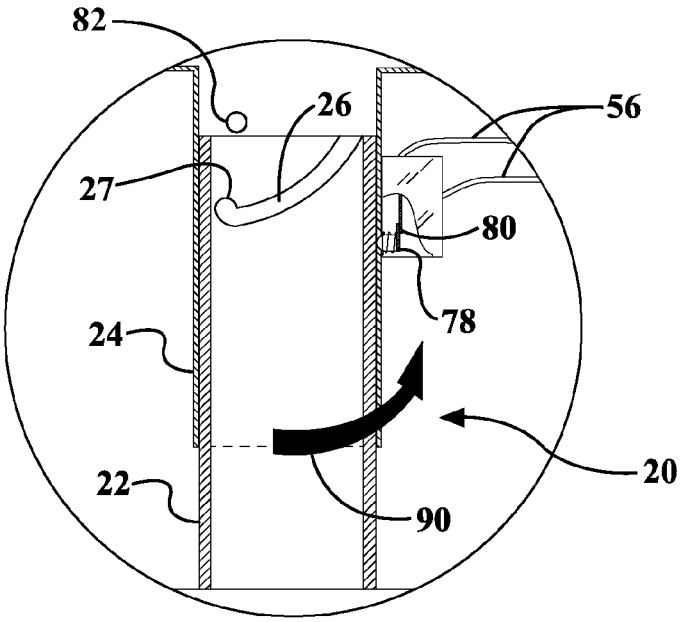
FIG. 9 is another enlarged, partial sectional view of the central support post assembly of the pop-up rotatable tray assembly (Detail "E"), according to an embodiment of the invention, wherein an engagement pin member of the central support post assembly is shown disposed outside of its respective helical slot so that the pop-up rotatable tray assembly is capable of freely rotating in its elevated position.
Figure 22:
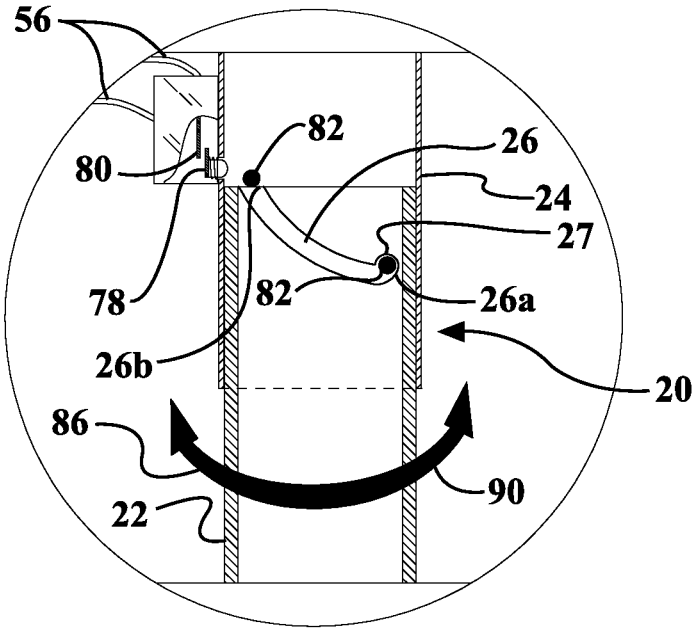
FIG. 22 is yet another enlarged, partial sectional view of the central support post assembly of the pop-up rotatable tray assembly (similar to Details "B" and "E"), according to an embodiment of the invention, wherein the engagement pin member of the central support post assembly is illustrated in both of its two end conditions.

In the illustrated embodiment, the plurality of light emitting devices 54 are configured to be automatically activated (i.e., turned "on") when the tray top member 60, 72 is disposed in its elevated position (i.e., the FIG. 1 position). Conversely, the plurality of light emitting devices 54 are configured to be automatically deactivated (i.e., turned "off") when the tray top member 60, 72 is disposed in its retracted position (i.e., the FIG. 2 position). In particular, the inner and outer conductive elements 78, 80 that are depicted in FIGS. 5, 9, and 22 operate as a switch for activating and deactivating the light emitting devices 54. As shown in these figures, the inner and outer conductive elements 78, 80 are both attached to the outer circular surface of the outer tubular member 24. The inner conductive element 78 is spring-loaded so as to only engage the outer conductive element 80 when the tray top member 60, 72 is in its elevated or raised position. Thus, when the tray top member 60, 72 of the pop-up rotatable tray assembly 10 is in its elevated position, the inner and outer conductive elements 78, 80 are in contact with one another (as shown in FIG. 9) so that a current pathway is created between the power source assembly 58 and the plurality of light emitting devices 54. On the other hand, when the tray top member 60, 72 of the pop-up rotatable tray assembly 10 is in its retracted position, the inner and outer conductive elements 78, 80 are spaced apart from one another by a gap (as shown in FIGS. 5 and 22) so that the flow of electrical current between the power source assembly 58 and the plurality of light emitting devices 54 is interrupted (i.e., the open circuit state) and the light emitting devices 54 are turned "off". In some embodiments, a supplementary on/off power switch is also provided on a side of the power source assembly 58.

Now, with particular reference to the views illustrated in FIGS. 3-5, 7-9, 11, and 22, the operation of the pop-up rotatable tray assembly 10 (i.e., a pop-up lazy susan 10) will be described in detail. When a user wants to raise the tray top member 60, 72 of the pop-up rotatable tray assembly 10 above the tabletop surface 116 (i.e., pop-up the rotatable tray assembly 10), he or she initially applies both a downward force and a clockwise torque (i.e., clockwise moment) to the top surface 11 of the tray top member 60, 72. In particular, the user applies downward forces (as indicated diagrammatically by the downward-pointing arrows 88 in FIG. 3) at two opposite locations on the top surface 11 of the tray top member 60, 72 (i.e., a user presses down against the top surface 11 using both of his or her hands). Preferably, as indicated diagrammatically by the arrows 88 in FIG. 3, each of the user's hands are positioned on opposite sides of the tray top member 60, 72 when the downward forces are being applied thereto. When the user applies the downward forces to the top surface 11 of the tray top member 60, 72, the engagement pin members 82 are each downwardly displaced within their respective slots 26 (e.g., see FIG. 5), thereby displacing the pin members 82 from their respective notches 27 at the first closed ends 26*a* of the slots 26 so that the pin members 82 are free to travel in an upward direction along the curved paths of the slots 26. As the user rotates the tray top member 60, 72 of the pop-up rotatable tray assembly 10 in a clockwise direction (as indicated diagrammatically by the curved arrows 86 in FIGS. 3 and 5), the pin members 82 travel upwardly in the respective slots 26 until reaching the second open ends 26*b* of the slots 26. While the pin members 82 are ascending within their respective slots 26, the spring members 38 of each peripheral support post assembly 32 apply upward pushing forces (as indicated diagrammatically by the upward-pointing arrow 94 in FIG. 8) so as to bias the tray top member 60, 72 towards its elevated position (i.e., FIG. 1 position). Once the engagement pin members 82 exit their respective slots 26 through their second open ends 26*b*, the tray top member 60, 72 is free to rotate in either a clockwise or counter-clockwise direction. That is, once the tray top member 60, 72 of the pop-up rotatable tray assembly 10 reaches its elevated position (e.g., as shown in FIG. 1), and the pin members 82 are disposed above their respective helical/arcuate slots 26, the tray top member 60, 72 is unconstrained by the slots 26, and is free to rotate in either direction by a user. As such, the tray top member 60, 72 of the pop-up rotatable tray assembly 10 is configured to be moved from its retracted position (FIG. 2) to the elevated position (FIG. 1) when the user applies both a downward force(s) 88 and a torque 86 in a first rotational direction (i.e., a clockwise direction) to the top surface 11 of the tray top member 60, 72. As explained above, once the tray top member 60, 72 of the pop-up rotatable tray assembly 10 reaches its elevated position, the inner and outer conductive elements 78, 80 are brought in contact with another so that the light emitting devices 54 are automatically illuminated.

Figure 2:
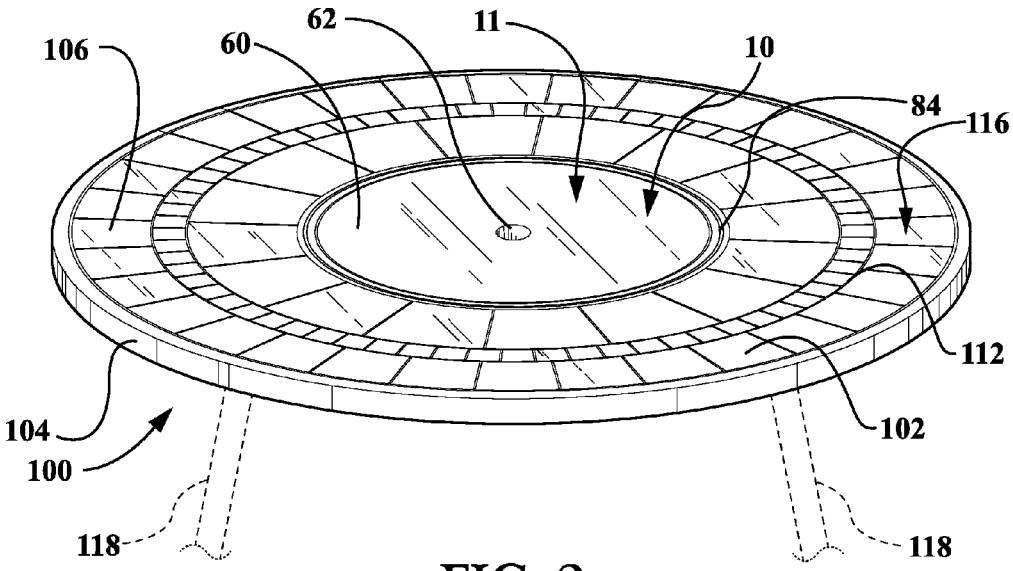
FIG. 2 is another perspective view of the tabletop assembly with the integrated pop-up rotatable tray assembly, according to an embodiment of the invention, wherein the pop-up rotatable tray assembly is disposed in a retracted position.
Figure 3:
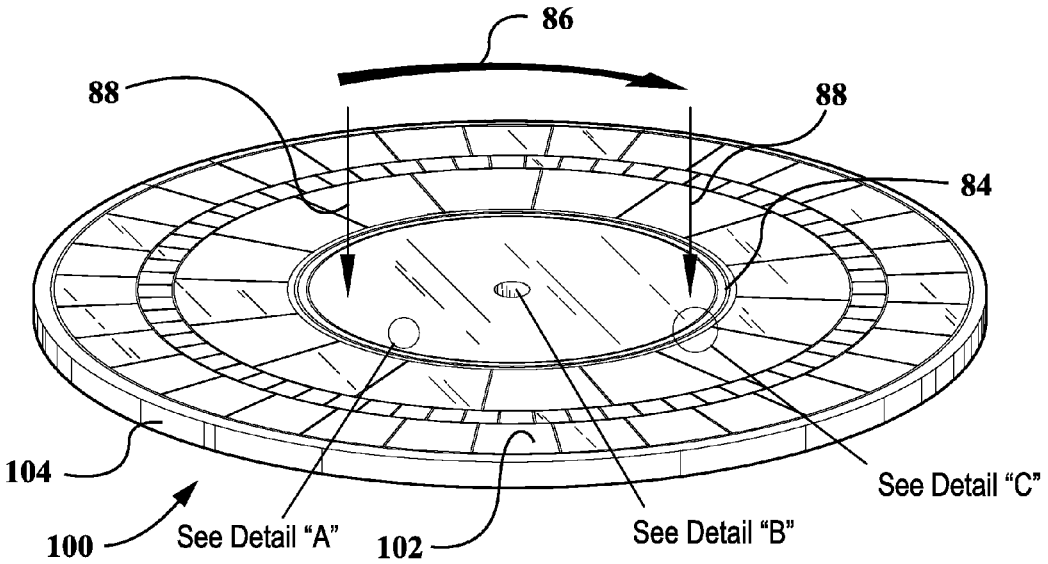
FIG. 3 is yet another perspective view of the tabletop assembly with the integrated pop-up rotatable tray assembly, according to an embodiment of the invention, wherein the pop-up rotatable tray assembly is disposed in a retracted position.
Figure 4:
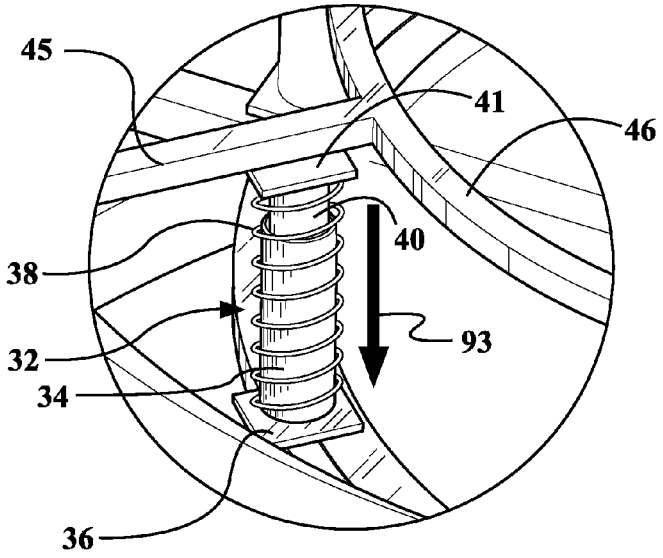
FIG. 4 is an enlarged, partial perspective view of one of the peripheral support post assemblies of the pop-up rotatable tray assembly (Detail "A"), according to an embodiment of the invention, wherein the spring member of the peripheral support post assembly is compressed.

Conversely, when a user wants to lower the tray top member 60, 72 of the pop-up rotatable tray assembly 10 back down to its retracted position (i.e., the FIG. 2 position) where the top surface 11 of the tray top member 60, 72 is disposed generally flush with the top surface 116 of the tabletop peripheral portion 102, he or she applies both a downward force and a counter-clockwise torque (i.e., counter-clockwise moment) to the top surface 11 of the tray top member 60, 72. In particular, the user applies downward forces (as indicated diagrammatically by the downward-pointing arrows 88' in FIG. 7) at two opposite locations on the top surface 11 of the tray top member 60, 72 (i.e., a user presses down against the top surface 11 using both of his or her hands). Preferably, as indicated diagrammatically by the arrows 88' in FIG. 7, each of the user's hands are positioned on opposite sides of the tray top member 60, 72 when the downward forces are being applied thereto. When the user applies the downward forces to the top surface 11 of the tray top member 60, 72, the engagement pin members 82 are each downwardly displaced against the top rim of the inner tubular member 22 (see e.g., FIG. 22). As the user rotates the tray top member 60, 72 of the pop-up rotatable tray assembly 10 in a counter-clockwise direction (as indicated diagrammatically by the curved arrows 90 in FIGS. 7, 9, and 22), each of the pin members 82 rotate around the top rim of the inner tubular member 22 until reaching the second open end 26*b* of its respective slot 26. Once each engagement pin member 82 reaches the second open end 26*b* of its respective slot 26, the downward forces, which are still being applied by the user, urges each engagement pin member 82 into its respective helical/arcuate slot 26 (i.e., each pin member 82 is essentially "caught" by the open end 26*b* of its respective slot 26, and thus, drawn into the slot 26). Upon entering each of their respective slots 26, the pin members 82 travel downwardly along the curved paths of their respective slots 26 until reaching the respective closed ends 26*a*. After the pin members 82 reach the closed ends 26*a* of their respective slots 26, they snap into the notches 27 (see FIGS. 5 and 22) so as to lock the tray top member 60, 72 of the pop-up rotatable tray assembly 10 its retracted position (e.g., as shown in FIG. 2). While the pin members 82 are descending within their respective slots 26, the spring members 38 of each peripheral support post assembly 32 are compressed (as indicated diagrammatically by the downward-pointing arrow 93 in FIG. 4) so as to create spring restoring forces in each of the spring members 38. The spring restoring forces created in each of the spring members 38 enables the engagement pin members 82 to snap into the notches 27 upon reaching the closed ends 26*a* of their respective slots 26. As such, the tray top member 60, 72 of the pop-up rotatable tray assembly 10 is configured to be moved from the elevated position (FIG. 1) to the retracted position (FIG. 2) when the user applies both a downward force(s) 88' and a torque 90 in a second rotational direction (i.e., a counter-clockwise direction) to the top surface 11 of the tray top member 60, 72. As explained above, once the tray top member 60, 72 of the pop-up rotatable tray assembly 10 reaches its retracted position, the inner and outer conductive elements 78, 80 are removed from contact with another so that the light emitting devices 54 are automatically turned off. The raising and lowering rotational directions (i.e., clockwise and counter-clockwise) could be reversed by flipping the direction of each engagement slot 26.

It is readily apparent that the aforedescribed pop-up rotatable tray assembly 10 and the tabletop 100 including the same offer numerous advantages. First, the tabletop assembly 100 with the integrated pop-up rotatable tray assembly 10 is capable of being easily retracted into the tabletop when it is not being used (e.g., the retracted position of the pop-up rotatable tray assembly 10 illustrated in FIGS. 2 and 3). Secondly, because pop-up rotatable tray assembly 10 is capable of being recessed into the surface of the tabletop, it does not obstruct the use of the tabletop surface. That is, when the pop-up rotatable tray assembly 10 is retracted, the tabletop 100 assembly can be utilized as a regular, flat table. Finally, the tabletop assembly 100 with the integrated pop-up rotatable tray assembly 10 described herein is geometrically configured to function effectively with the overall shape and size of the tabletop (i.e., when the pop-up rotatable tray assembly 10 is being used in its elevated position, individuals that are sitting around the table can easily reach one or more dishes disposed in the center portion of the table without requiring the dishes to be passed from one individual to another).

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A tabletop assembly comprising, in combination:

a tabletop peripheral portion, said tabletop peripheral portion having a central aperture disposed therethrough;

a pop-up rotatable tray assembly disposed within said central aperture of said tabletop peripheral portion, said pop-up rotatable tray assembly including:

a base portion;

a tray support structure, said tray support structure rotatably coupled to said base portion, said tray support structure of said pop-up rotatable tray assembly comprising an upper tray support frame, a central tubular member connected to a bottom surface of said upper tray support frame, and a plurality of peripheral support post assemblies spaced apart around said central tubular member, each of said plurality of peripheral support post assemblies comprising an inner tubular member, an outer tubular member, and a spring member disposed around said inner tubular member and said outer tubular member, said inner tubular member of each of said plurality of peripheral support assemblies being connected to said bottom surface of said upper tray support frame; and a tray top member, said tray top member supported on said upper tray support frame of said tray support structure, said tray top member configured to be adjustable between an elevated position and a retracted position, said spring member of each of said plurality of peripheral support post assemblies of said tray support structure configured to bias said tray top member towards said elevated position by applying an upward pushing force against said bottom surface of said upper tray support frame on which said tray top member is supported;

wherein, when said tray top member is disposed in said elevated position, said tray top member is spaced apart from said base portion by a first distance, and wherein, when said tray top member is disposed in said retracted position, said tray top member is spaced apart from said base portion by a second distance, said first distance being greater than said second distance.

2. The tabletop assembly according to claim 1, wherein said base portion of said pop-up rotatable tray assembly comprises a central support post member disposed in an approximate center thereof, said central support post member including at least one helical slot formed therein, said central support post member of said base portion configured to engage with said central tubular member of said tray support structure.

3. The tabletop assembly according to claim 2, wherein said base portion of said pop-up rotatable tray assembly further comprises a plurality of spoke members extending radially outward from said central support post member.

4. The tabletop assembly according to claim 2, wherein said pop-up rotatable tray assembly further comprises at least one engagement pin member that is configured to slidingly engage with said at least one helical slot in said central support post member of said base portion.

5. The tabletop assembly according to claim 4, wherein said at least one engagement pin member is disposed on an inside surface of said central tubular member of said tray support structure.

6. The tabletop assembly according to claim 1, wherein said pop-up rotatable tray assembly further comprises a lighting assembly, said lighting assembly including a plurality of light emitting devices operatively coupled to a power source assembly by one or more electrical wires, said plurality of light emitting devices configured to illuminate one of: (i) at least a portion of said tray top member, and (ii) at least a portion of an outer peripheral rim of said pop-up rotatable tray assembly.

7. The tabletop assembly according to claim 6, wherein said plurality of light emitting devices are configured to be automatically activated when said tray top member is disposed in said elevated position, and said plurality of light emitting devices are configured to be automatically deactivated when said tray top member is disposed in said retracted position.

8. A pop-up rotatable tray assembly comprising, in combination:

a base portion, said base portion comprising a support post member with an upper rim portion and at last one curved slot disposed therethrough, said at least one curved slot having a first closed end and a second open end;

a tray support structure, said tray support structure rotatably coupled to said base portion, said tray support structure comprising a tubular member with at least one engagement pin member that is configured to slidingly engage with said at least one curved slot in said support post member of said base portion; and a tray top member having a top surface, said tray top member supported on said tray support structure, said tray top member configured to be adjustable between an elevated position and a retracted position, and, when a user applies a downward force and a torque in a first rotational direction to said top surface of said tray top member, said at least one engagement pin member of said tubular member of said tray support structure is downwardly displaced and rotated around said upper rim portion of said support post member until reaching said second open end of said at least one curved slot, whereupon reaching said second open end of said at least one curved slot, said at least one engagement pin member enters said at least one curved slot and travels in a downward path within said at least one curved slot as said tray top member that is supported on said tray support structure is moved between said elevated position and said retracted position;

wherein, when said tray top member is disposed in said elevated position, said tray top member is spaced apart from said base portion by a first distance, and wherein, when said tray top member is disposed in said retracted position, said tray top member is spaced apart from said base portion by a second distance, said first distance being greater than said second distance.

9. The pop-up rotatable tray assembly according to claim 8, wherein said first closed end of said at least one curved slot of said support post member includes a notch formed therein; and wherein, when said user applies a downward force and a torque in a second rotational direction to said top surface of said tray top member, said at least one engagement pin member of said tubular member of said tray support structure is downwardly displaced and disengaged from said notch in said first closed end of said at least one curved slot, whereupon said at least one engagement pin member travels in an upward path within said at least one curved slot as said tray top member that is supported on said tray support structure is moved from said retracted position to said elevated position.

10. The pop-up rotatable tray assembly according to claim 9, wherein said second rotational direction for raising said tray top member is opposite to said first rotational direction for lowering said tray top member.

11. The pop-up rotatable tray assembly according to claim 9, wherein, when said tray top member is disposed in said retracted position, said at least one engagement pin member is disposed in said notch at said first closed end of said at least one curved slot such that said tray top member is locked into a stationary position relative to said base portion; and wherein, when said tray top member is disposed in said elevated position, said at least one engagement pin member is disposed above said second open end of said at least one curved slot and is unconstrained by said at least one curved slot such that said tray top member is capable of being freely rotated in both a clockwise direction and a counter-clockwise direction by said user.

12. The pop-up rotatable tray assembly according to claim 8, wherein said support post member is disposed in an approximate center of said base portion, and wherein said at least one curved slot of said support post member has a helical shape.

13. A tabletop assembly comprising, in combination:

a tabletop peripheral portion, said tabletop peripheral portion having a central aperture disposed therethrough, said tabletop peripheral portion further including a top surface;

a pop-up rotatable tray assembly disposed within said central aperture of said tabletop peripheral portion, said pop-up rotatable tray assembly including:

a base portion comprising a peripheral member, a central support post member, and a plurality of spoke members extending between said peripheral member and said central support post member, said plurality of spoke members supporting said central support post member;

a tray support structure, said tray support structure rotatably coupled to said base portion, said tray support structure comprising a central tubular member configured to displaceably engage said central support post member of said base portion, and said tray support structure further comprising a plurality of peripheral support post assemblies spaced apart around said central tubular member, each of said plurality of peripheral support assemblies comprising inner tubular member and a respective outer tubular member, each said inner tubular member being slidably disposed relative to said respective outer tubular member; and a tray top member, said tray top member supported by said tray support structure, said tray top member configured to be adjustable between an elevated position and a retracted position;

wherein, when said tray top member is disposed in said elevated position, said tray top member is spaced apart from said top surface of said tabletop peripheral portion by a vertical distance, and wherein, when said tray top member is disposed in said retracted position, a top surface of said tray top member is substantially aligned with said top surface of said tabletop peripheral portion.

14. The tabletop assembly according to claim 13, wherein said base portion of said pop-up rotatable tray assembly is fixedly attached to an underside of said tabletop peripheral portion.

15. The tabletop assembly according to claim 13, wherein said tray top member of said pop-up rotatable tray assembly comprises an aperture disposed therein for receiving a pole member.

16. The tabletop assembly according to claim 13, wherein said tray top member of said pop-up rotatable tray assembly is spaced apart from said tabletop peripheral portion by a continuous gap disposed about an outer periphery thereof such that said tray top member is capable of freely rotating relative to said tabletop peripheral portion.

17. The tabletop assembly according to claim 13, wherein said tray top member of said pop-up rotatable tray assembly comprises an annular member disposed about an outer periphery thereof, a first portion of said annular member configured to be disposed below said top surface of said tabletop peripheral portion when said tray top member is disposed in said elevated position, and a second portion of said annular member configured to be disposed above said top surface of said tabletop peripheral portion when said tray top member is disposed in said elevated position.

18. The tabletop assembly according to claim 13, wherein said pop-up rotatable tray assembly is structurally supported only by said tabletop peripheral portion.

* * * * *